US006544937B2

(12) United States Patent
Hewson et al.

(10) Patent No.: US 6,544,937 B2
(45) Date of Patent: Apr. 8, 2003

(54) DEMULSIFICATION OF INDUSTRIAL LUBRICANTS CONTAINING NAPHTHENIC BASESTOCKS

(75) Inventors: William Donald Hewson, Sarnia (CA); Terrence Edward Addley, Sarnia (CA)

(73) Assignee: ExxonMobile Research and Engineering Company, Annandale, NJ (US)

( * ) Notice: Subject to any disclaimer, the term of this patent is extended or adjusted under 35 U.S.C. 154(b) by 0 days.

(21) Appl. No.: 10/104,361

(22) Filed: Mar. 22, 2002

(65) Prior Publication Data

US 2002/0193261 A1 Dec. 19, 2002

Related U.S. Application Data

(60) Provisional application No. 60/292,718, filed on May 22, 2001.

(51) Int. Cl.[7] ..... C10M 105/02; C10M 129/04; C10M 129/74

(52) U.S. Cl. ..... 508/485; 508/492; 508/494

(58) Field of Search ..... 508/485, 492, 508/494

(56) References Cited

U.S. PATENT DOCUMENTS

| | | | | | |
|---|---|---|---|---|---|
| 3,773,668 | A | * | 11/1973 | Denis et al. | 508/494 |
| 3,915,871 | A | * | 10/1975 | Bryer et al. | 508/485 |
| 3,920,562 | A | * | 11/1975 | Foehr | 508/493 |
| 3,920,956 | A | | 11/1975 | Endo et al. | 219/503 |
| 5,064,546 | A | * | 11/1991 | Dasai | 508/485 |
| 5,273,672 | A | * | 12/1993 | Dasai et al. | 508/485 |
| 6,426,322 | B2 | * | 7/2002 | Alexander | 508/110 |

* cited by examiner

*Primary Examiner*—Jacqueline V. Howard
(74) *Attorney, Agent, or Firm*—Norby L. Foss

(57) ABSTRACT

A lubricating composition containing naphthenic basestocks has demulsification properties improved by the addition of a demulsification additive selected from oxyalkylated glycols, esters of oxyalkylated glycols and mixtures thereof.

8 Claims, No Drawings

DEMULSIFICATION OF INDUSTRIAL LUBRICANTS CONTAINING NAPHTHENIC BASESTOCKS

This application claims the benefit of U.S. Provisional Application No.: 60/292,718 filed May 22, 2001.

FIELD OF INVENTION

The present invention relates generally to industrial lubricants. More specifically the invention relates to industrial gear oils for service in cold temperature operations.

BACKGROUND OF INVENTION

The art of lubricating oil formulation has become increasingly complex with ever more stringent standards dictated by developing industrial equipment technology. For example, industrial gear oils are needed for service over a wide range of climate conditions. To meet cold temperature service conditions the lubricant must have a low pour point and a low viscosity. Low pour points and low viscosity can be achieved using a basestock that contains a substantial amount of a very light naphthenic oil.

Another requirement of industrial gear oils is that they be capable of demulsifying water which often contaminates the gear oil under conditions of use. Unfortunately, naphthenic oils used in gear oil products are readily emulsified.

In addition to the low temperature and demulsification properties, industrial oils need to protect the lubricated parts against extreme pressure. Consequently, industrial oils such as gear oils are formulated to contain extreme pressure additive systems. Thus, typically they include a dispersant to prevent gearbox sludge deposits. The dispersants, however, tends to be effective in emulsifying low viscosity naphthenic oils.

An object of the present invention therefore is to provide an industrial lubricant that is has good low temperature properties and that is capable of demulsifying water.

SUMMARY OF INVENTION

According to the invention, a lubricant composition especially useful as a gear oil, comprises:

(a) a base oil consisting essentially of a mixture of (i) at least about 10 wt % based on the total weight of the composition of one or more naphthenic oils having a viscosity in the range of in the range of about 6 to about 80 cSt at 40° C.;

(ii) about 10 to about 90 wt % based on the weight of the composition of a mineral oil having a viscosity in the range of about 100 to about 500 cSt at 40° C.; and (b) an effective amount of a demulsification additive selected from the group consisting of oxyalkylated glycols, esters of oxyalkylated glycols and mixtures thereof.

Other embodiments of the invention will become apparent from the detailed description which follows:

DETAILED DESCRIPTION OF THE INVENTION

A. The Base Oil

The lubricant compositions of the present invention are especially useful as gear oils and comprise a major amount of a base oil which consists essentially of a mixture of a naphthenic oil and a mineral oil.

(i) The Naphthenic Oil

The naphthenic oil used in the base oil may be selected from one or more naphthenic oils having a viscosity in the range of about 6 to about 80 cSt at 40° C. and preferably in the range of 6 to 20 cSt at 40° C. The naphthenic oil or oils will comprise at least about 10 wt % of the total weight of the composition, for example from about 10 to about 70 wt %.

(ii) The Mineral Oil

The mineral oil used in the base oil may be selected from any of the natural mineral oils of API Groups I, II, III or mixtures of these having a viscosity in the range of about 100 to about 500 cSt at 40° C. Especially preferred are solvent extracted bright stocks having a viscosity in the range of 350 to 500 cSt at 40° C.

B. The demulsification Additive

The lubricant compositions also includes an effective amount of a demulsification additive selected from the group consisting of oxyalkylated glycols, esters of oxyalkylated glycols and mixtures thereof Typically the glycols will have from 2 to 10 carbon atoms and preferably 2 carbon atoms. Also the alkylene groups of the oxyalkylates may have from 2 to about 10 carbon atoms although the oxyalkylate preferably are oxyethylene, oxypropylene, and mixtures of oxyethylene and oxypropylene groups. The oxyalkylated esters preferably are derived from glycols of from 2 to about 20 carbon atoms and dibasic acids and acid anhydrides having from about 2 to 10 carbon atoms, especially maleic acid or anhydride. Suitable oxyalkylated glycols and esters of oxyalkylated glycols typically have molecular weights in excess of about 50,000, for example in the range of about 100,000 to about 500,000, and even higher. Such demulsification additives are commercially available materials.

Typically the demulsification additives will comprise from about 0.002 to about 0.04 wt % of the composition and preferably about 0.02 to about 0.03 wt %.

C. Other Additives

The composition of the present invention may include other additives such as extreme pressure agents, metal deactivators, antioxidants, rust inhibitors, pour point depressants, dispersants, and antifoamants.

Among suitable extreme pressure agents are olefin polysulfides and phosphate esters.

For antioxidants hindered phenols and alkylated diphenyl amines are especially useful.

Benzotriazole derivatives are useful in the lubricant composition as a metal passivator.

Polymethylacrylates exemplify useful pour point depressants.

Alkyl succinimides may be used as antitrust additives.

Among suitable dispersants mention is made of polyisobutylene succinic anhydride polyamine.

The antifoamant used typically will be a silicone oil antifoamant.

The foregoing additives are all commercially available materials. Indeed, these additives are usually not added independently but are precombined in packages which can be obtained from suppliers of lube oil additives. Additive packages with a variety of ingredients, proportions and characteristics are available and selection of the appropriate package will take the requisite use of the ultimate composition into account.

EXAMPLES

A series of industrial lubricants were formulated containing as the base oil a mixture of a naphthenic oil having a viscosity of 8.0 cSt at 40° C. and a bright stock having a viscosity of 456 cSt at 40° C. All of the formulations included an additive package that contained among its ingredients an extreme pressure agent, rust inhibitor, dispersant, antifoamant, antioxidant, metal passivator and an ethylene oxide propylene oxide block copolymer known to demulsify gear oils prepared with paraffinic basestocks. Six of the formulations included additional ethylene oxide propylene oxide block copolymer. Finally, six of the formulated lubricants also contained a demulsification additive of the present invention. All of the formulations were evaluated using ASTM test method D 1401. The compositions and results are given in Table 1, 2 and 3.

As can be seen those compositions (4, 5, 9, 10, 14 and 15) containing the demulsification additive of the present invention resulted in fast and complete demulsification as determined in the tests.

TABLE 1

| | Formulation | | | | |
|---|---|---|---|---|---|
| Components | 1 | 2 | 3 | 4 | 5 |
| Naphthenic oil, wt % | 60.31 | 60.31 | 60.31 | 60.31 | 60.31 |
| Bright Stock, wt % | 37.44 | 37.44 | 37.44 | 37.44 | 37.44 |
| Additive Package, wt % | 1.80 | 1.80 | 1.80 | 1.80 | 1.80 |
| Pour Point Depressant | 0.45 | 0.45 | 0.45 | 0.45 | 0.45 |
| Polyether① | | +100 ppm | +200 ppm | | |
| Oxylated Glycol Ester② | | | | +200 ppm | |
| Oxylated Glycol③ | | | | | +200 ppm |
| TOTAL | 100.00 | 100.00 | 100.00 | 100.00 | 100.00 |
| Inspections | | | | | |
| KV 40° C. cSt | 32.56 | | | | |
| KV 100° C. cSt | 5.71 | | | | |
| VI | 116 | | | | |
| Phosphorus ppm | 224 | | | | |
| Calcium ppm | 24 | | | | |
| Demulsification ASTM D 1401 | 54 C | 54 C | 54 C | 54 C | 54 C |
| oil-water-emulsion/minutes | 33-33-14/5 | 35-22-13/5 | 37-34-9/5 | 41-35-4/5 | 40-36-4/5 |
| oil-water-emulsion/minutes | 35-34-11/10 | 37-35-8/10 | 38-34-8/10 | 41-37-2/10 | 40-36-4/10 |
| oil-water-emulsion/minutes | 36-34-10/15 | 37-35-8/30 | 38-34-8/30 | 40-38-2/20 | 40-38-2/15 |
| oil-water-emulsion/minutes | 37-34-9/20 | 37-35-9/40 | 38-34-8/40 | 41-39-1/35 | 40-38-2/60 |
| oil-water-emulsion/minutes | 37-34-9/55 | 37-35-9/60 | 38-34-8/60 | 41-39-1/60 | |
| oil-water-emulsion/minutes | 38-34-8/60 | | | | |
| Demulse comment | slow & incomplete | slow & incomplete | slow & incomplete | fast & complete | fast & complete |
| Demulse perfection | 40-40-0-fast | 40-40-0-fast | 40-40-0-fast | 40-40-0-fast | 40-40-0-fast |

①Ethylene oxide-propylene oxide block copolymer.
②The oxylated glycol ester used is available as Nalco EC 5752A from Nalco/Exxon, Sugarland, Texas.
③The oxylated glycol used is available as Tolad 932 from Baker Hughes, Sugarland, Texas.

TABLE 2

| | Formulation | | | | |
|---|---|---|---|---|---|
| Components | 6 | 7 | 8 | 9 | 10 |
| Naphthenic oil, wt % | 44.94 | 44.94 | 44.94 | 44.94 | 44.94 |
| Bright Stock, wt % | 30.00 | 30.00 | 30.00 | 30.00 | 30.00 |
| Additive Package, wt % | 1.80 | 1.80 | 1.80 | 1.80 | 1.80 |
| Pour Point Depressant | 0.45 | 0.45 | 0.45 | 0.45 | 0.45 |
| Polyether① | | +100 ppm | +200 ppm | | |
| Oxylated Glycol Ester② | | | | +200 ppm | |
| Oxylated Glycol③ | | | | | +200 ppm |
| Thickener④ | 22.81 | 22.81 | 22.81 | 22.81 | 22.81 |
| TOTAL | 100.00 | 100.00 | 100.00 | 100.00 | 100.00 |
| Inspections | | | | | |
| KV 40° C. cSt | 152.6 | | | | |
| KV 100° C. cSt | 17.35 | | | | |
| VI | 124 | | | | |
| Phosphorus ppm | 222 | | | | |
| Calcium ppm | 25 | | | | |
| Demulsification ASTM D 1401 | 82 C | 82 C | 82 C | 82 C | 82 C |
| oil-water-emulsion/minutes | 0-21-69/5 | 1-0-79/5 | 2-0-78/5 | 38-35-7/5 | 38-35-7/5 |
| oil-water-emulsion/minutes | 12-22-46/10 | 4-0-76/10 | 5-0-75/10 | 39-38-3/10 | 39-38-3/10 |
| oil-water-emulsion/minutes | 20-22-38/15 | 9-0-71/20 | 12-0-68/20 | 40-39-1/20 | 40-39-1/20 |
| oil-water-emulsion/minutes | 26-22-32/20 | 12-0-68/30 | 16-0-64/30 | 40-39-1/60 | 40-39-1/60 |
| Demulse comment | slow & | slow & | slow & | fast & | fast & |

TABLE 2-continued

| Components | Formulation 6 | 7 | 8 | 9 | 10 |
|---|---|---|---|---|---|
| Demulse perfection | incomplete 40-40-0-fast | incomplete 40-40-0-fast | incomplete 40-40-0-fast | complete 40-40-0-fast | complete 40-40-0-fast |

(1)Ethylene oxide-propylene oxide block copolymer.
(2)The oxylated glycol ester used is available as Nalco EC 5752A from Nalco/Exxon, Sugarland, Texas.
(3)The oxylated glycol used is available as Tolad 932 from Baker Hughes, Sugarland, Texas.
(4)Polyisobutylene of ~2000 molecular weight.

TABLE 3

| Components | Formulation 11 | 12 | 13 | 14 | 15 |
|---|---|---|---|---|---|
| Naphthenic oil, wt % | 49.82 | 49.82 | 49.82 | 49.82 | 49.82 |
| Bright Stock, wt % | 30.00 | 30.00 | 30.00 | 30.00 | 30.00 |
| Additive Package, wt % | 1.80 | 1.80 | 1.80 | 1.80 | 1.80 |
| Pour Point Depressant | 0.45 | 0.45 | 0.45 | 0.45 | 0.45 |
| Polyether(1) | | +100 ppm | +200 ppm | | |
| Oxylated Glycol Ester(2) | | | | +200 ppm | |
| Oxylated Glycol(3) | | | | | +200 ppm |
| Thickener(4) | 17.93 | 17.93 | 17.93 | 17.93 | 17.93 |
| TOTAL | 100.00 | 100.00 | 100.00 | 100.00 | 100.00 |
| Inspections | | | | | |
| KV 40° C. cSt | 101.6 | | | | |
| KV 100° C. cSt | 13.03 | | | | |
| VI | 125 | | | | |
| Phosphorus ppm | 225 | | | | |
| Calcium ppm | 25 | | | | |
| Demulsification ASTM D 1401 | 82 C | 82 C | 82 C | 82 C | 82 C |
| oil-water-emulsion/minutes | 1-0-79/5 | 19-26-45/5 | 2-0-78/5 | 0-31-49/5 | 39-38-3/5 |
| oil-water-emulsion/minutes | 4-0-76/10 | 29-26-35/10 | 5-0-75/10 | 40-40-0/10 | 39-39-2/10 |
| oil-water-emulsion/minutes | 9-0-71/20 | 33-26-21/20 | 10-0-70/20 | 40-40-0/30 | 39-39-2/60 |
| oil-water-emulsion/minutes | 12-0-68/30 | 35-26-19/30 | 15-0-65-30 | | |
| Demulse comment | slow & incomplete | slow & incomplete | slow & incomplete | fast & complete | fast & complete |
| Demulse perfection | 40-40-0-fast | 40-40-0-fast | 40-40-0-fast | 40-40-0-fast | 40-40-0-fast |

(1)Ethylene oxide-propylene oxide block copolymer.
(2)The oxylated glycol ester used is available as Nalco EC 5752A from Nalco/Exxon, Sugarland, Texas.
(3)The oxylated glycol used is available as Tolad 932 from Baker Hughes, Sugarland, Texas.
(4)Polyisobutylene of ~2000 molecular weight.

What is claimed is:

1. A lubricant composition comprising a major amount of:

(A) a base oil consisting essentially of a mixture of (i) at least about 10 wt % based on the total weight of the composition of one or more naphthenic oils having a viscosity in the range of about 6 to about 8 cSt at 40° C.; and (ii) about 10 to about 90 wt % based on the weight of the composition of a mineral oil having a viscosity in the range of about 100 to about 500 cSt at 40° C.; and (B) an effective amount of a demulsification additive selected from the group consisting of oxyalkylated glycols, esters of oxyalkylated glycols and mixtures thereof.

2. The composition of claim 1 wherein the mineral oil is a solvent refined bright stock.

3. The composition of claims 1 and 2 wherein the demulsification additive comprises from about 0.002 to about 0.04 wt % of the composition.

4. The composition of claim 3 wherein the demulsification additive has a molecular weight greater than about 50,000.

5. The composition of claim 4 wherein the oxyalkylates of the demulsification additives are a mixture of oxyethylene and oxypropylene.

6. A method for enhancing the demulsification properties of a gear oil containing at least 10 wt % of a naphthenic oil and from 10 to 90 wt % of a mineral oil comprising adding to the gear oil an effective amount of a demulsification additive selected from the group consisting of oxyalkylated glycols, esters of oxyalkylated glycols and mixtures thereof.

7. The method of claim 6 wherein the demulsification additive comprises from about 0.002 to about 0.04 wt % of the gear oil.

8. The method of claim 7 wherein the demulsification additive has a molecular weight greater than about 50,000.

* * * * *